US011521550B2

(12) United States Patent
Liu et al.

(10) Patent No.: US 11,521,550 B2
(45) Date of Patent: Dec. 6, 2022

(54) DATA CURRENT GENERATION CIRCUIT INCLUDING A COMPENSATION CONTROL CIRCUIT, DRIVING METHOD, DRIVER CHIP AND DISPLAY PANEL

(71) Applicant: SEEYA OPTRONICS CO., LTD., Shanghai (CN)

(72) Inventors: Ping-lin Liu, Shanghai (CN); Haodong Zhang, Shanghai (CN)

(73) Assignee: SEEYA OPTRONICS CO., LTD., Shanghai (CN)

( * ) Notice: Subject to any disclaimer, the term of this patent is extended or adjusted under 35 U.S.C. 154(b) by 0 days.

(21) Appl. No.: 17/526,056

(22) Filed: Nov. 15, 2021

(65) Prior Publication Data

US 2022/0208098 A1 Jun. 30, 2022

(30) Foreign Application Priority Data

Dec. 31, 2020 (CN) ..... 202011627123.X

(51) Int. Cl.
*G09G 3/3241* (2016.01)
*G09G 3/3258* (2016.01)
*G09G 3/3275* (2016.01)

(52) U.S. Cl.
CPC ..... *G09G 3/3241* (2013.01); *G09G 3/3258* (2013.01); *G09G 3/3275* (2013.01)

(58) Field of Classification Search
None
See application file for complete search history.

(56) References Cited

U.S. PATENT DOCUMENTS

2007/0236424 A1* 10/2007 Kimura ..... H01L 27/3276 345/76
2011/0254871 A1* 10/2011 Yoo ..... G09G 3/3233 345/77
2013/0120338 A1* 5/2013 Kubota ..... G09G 3/3208 257/E33.044
2018/0061328 A1* 3/2018 Kishi ..... G09G 3/3266
2019/0180696 A1* 6/2019 Park ..... H01L 27/3276
2019/0237006 A1* 8/2019 Cheng ..... G09G 3/3225

* cited by examiner

*Primary Examiner* — Kirk W Hermann
(74) *Attorney, Agent, or Firm* — Duane Morris LLP

(57) ABSTRACT

A data current generation circuit includes a data voltage generation circuit, a data voltage transmission control circuit, a compensation control circuit, a first capacitor, a first transistor and a reference voltage writing circuit. The data voltage transmission control circuit transmits a data voltage from the data voltage generation circuit to a first electrode of the first transistor; the compensation control circuit is electrically connected to a gate and a second electrode of the first transistor separately and associates a threshold voltage of the first transistor with the gate of the first transistor; the first capacitor stores a voltage of the gate of the first transistor; the reference voltage writing circuit is electrically connected to the first electrode of the first transistor and a first reference voltage output terminal separately; and the second electrode of the first transistor serves as an output of the data current generation circuit.

11 Claims, 9 Drawing Sheets

DATA CURRENT GENERATION CIRCUIT INCLUDING A COMPENSATION CONTROL CIRCUIT, DRIVING METHOD, DRIVER CHIP AND DISPLAY PANEL

CROSS-REFERENCE TO RELATED APPLICATION(S)

This application claims priority to Chinese Patent Application No. 202011627123.X filed Dec. 31, 2020, the disclosure of which is incorporated herein by reference in its entirety.

TECHNICAL FIELD

The present disclosure relates to the field of display technologies and, in particular, to a data current generation circuit, a driving method, a driver chip and a display panel.

BACKGROUND

A current-type pixel driving circuit includes a pixel driving current generation circuit that provides a data current for a pixel circuit. The pixel driving current generation circuit can convert a data voltage to a data current and then provides the data current for the pixel circuit.

In the process of the pixel driving current generation circuit converting the data voltage to the data current, since a transistor that generates the data current has a threshold voltage, the real data current converted from the data voltage may deviate from the theoretical data current, resulting in poor uniformity of a display panel.

SUMMARY

Embodiments of the present disclosure provide a data current generation circuit, a driving method, a driver chip and a display panel, so as to improve the uniformity of a display panel.

In a first aspect, an embodiment of the present disclosure provides a data current generation circuit including a data voltage generation circuit, a data voltage transmission control circuit, a compensation control circuit, a first capacitor, a first transistor and a reference voltage writing circuit.

The data voltage generation circuit is configured to generate a data voltage.

The data voltage transmission control circuit is connected between the data voltage generation circuit and a first electrode of the first transistor and configured to transmit the data voltage to the first electrode of the first transistor. The compensation control circuit is electrically connected to a gate of the first transistor and a second electrode of the first transistor separately and configured to associate a threshold voltage of the first transistor with the gate of the first transistor. The first capacitor includes a first electrode electrically connected to the gate of the first transistor and a second electrode electrically connected to a first reference voltage output terminal and is configured to store a voltage of the gate of the first transistor. The reference voltage writing circuit is electrically connected to the first electrode of the first transistor and the first reference voltage output terminal separately and configured to write a first reference voltage of the first reference voltage output terminal into the first electrode of the first transistor. The second electrode of the first transistor serves as an output of the data current generation circuit and is configured to output a data current according to the voltage of the gate of the first transistor.

In a second aspect, an embodiment of the present disclosure provides a data current driver chip. The data current driver chip includes the data current generation circuit according to any embodiment of the present disclosure.

In a third aspect, an embodiment of the present disclosure further provides a display panel. The display panel includes a display region and a non-display region; where the display region is provided with a plurality of pixel circuits and the non-display region is provided with the data current generation circuit according to any embodiment of the present disclosure.

The plurality of pixel circuits are electrically connected to the data current generation circuit through a data line and a switch circuit; and the data current generation circuit provides a data current for the plurality of pixel circuits through the data line and the switch circuit.

In a fourth aspect, an embodiment of the present disclosure further provides a method for driving the data current generation circuit according to any embodiment of the present disclosure. The method includes steps described below.

At an initialization stage, a data voltage generation circuit of the data current generation circuit is controlled to output a data voltage to a data voltage transmission control circuit, the data voltage transmission control circuit is controlled to transmit the data voltage to a first electrode of a first transistor while a compensation control circuit is controlled to associate a threshold voltage of the first transistor of the data current generation circuit with a gate of the first transistor, and a voltage of the gate of the first transistor is stored through a first capacitor.

At a programming stage, a reference voltage writing circuit is controlled to write a first reference voltage into a first electrode of the first transistor and the first transistor outputs a data current according to the voltage of the gate.

In the present disclosure, the data current generation circuit includes the data voltage generation circuit, the data voltage transmission control circuit, the compensation control circuit, the first capacitor, the first transistor and the reference voltage writing circuit. In an operation process of the data current generation circuit, the data voltage generation circuit can generate the data voltage and transmit the data voltage to the first electrode of the first transistor through the data voltage transmission control circuit, the compensation control circuit can associate the threshold voltage of the first transistor with the gate of the first transistor, the first capacitor stores the voltage of the gate of the first transistor, then the reference voltage writing circuit can write the first reference voltage to the first electrode of the first transistor, and the second electrode of the first transistor serves as the output and outputs the data current according to the voltage of the gate. In this embodiment, the voltage of the gate of the first transistor for outputting the data current is related to the threshold voltage of the first transistor. When the first transistor outputs the data current, the voltage of the gate can compensate for an effect of the threshold voltage of the first transistor on the data current so that a degree of matching between the data voltage and the data current can be improved, thereby improving the uniformity of the display panel.

DETAILED DESCRIPTION

Figure 1:
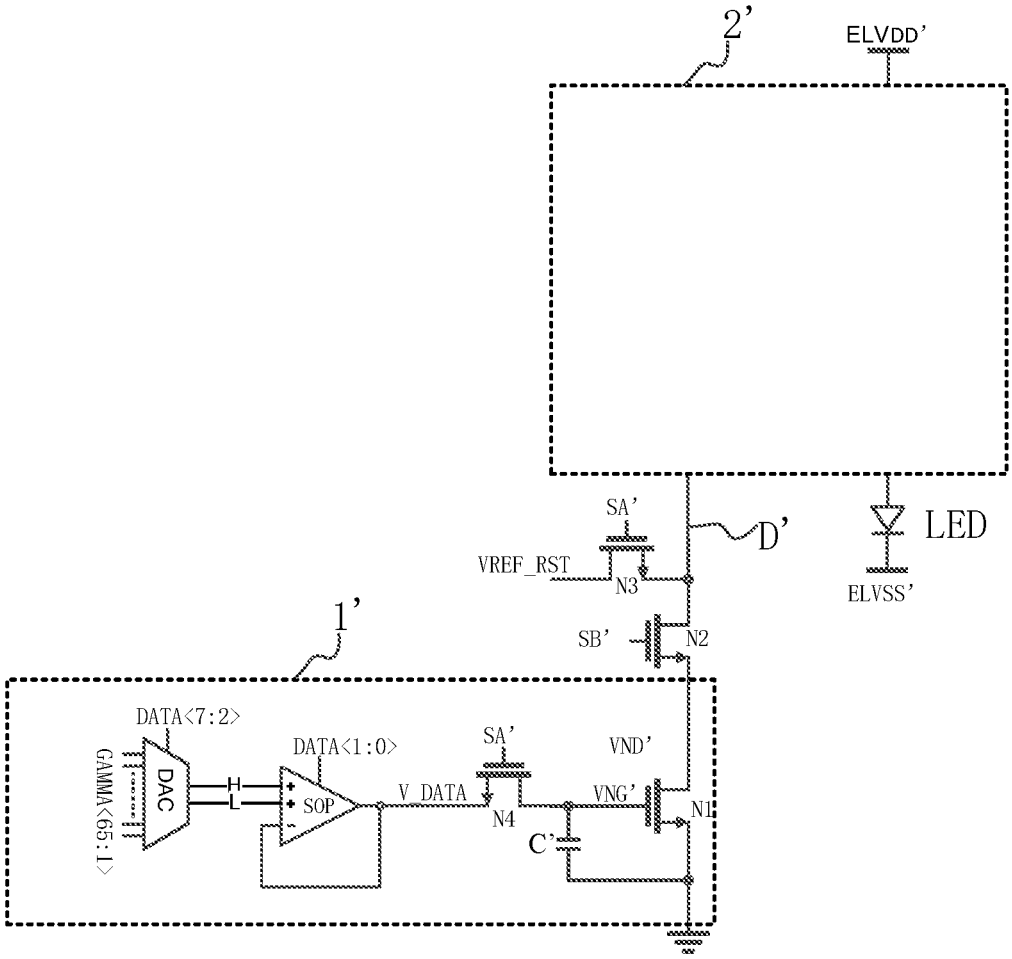
FIG. 1 (PRIOR ART)
FIG. 1 is a structure diagram of a data current generation circuit that provides a data current for a pixel circuit in the related art.

The present disclosure is further described below in detail in conjunction with drawings and embodiments. It is to be understood that the embodiments described herein are merely intended to explain the present disclosure and not to limit the present disclosure. Additionally, it is to be noted that for ease of description, merely part, not all, of the structures related to the present disclosure are illustrated in the drawings.

FIG. 1 is a structure diagram of a data current generation circuit that provides a data current for a pixel circuit in the related art. As shown in FIG. 1, the data current generation circuit 1' includes a source operational amplifier (SOP), a first N-type transistor N1 and a second N-type transistor N4. The data current generation circuit 1' is connected to the pixel circuit 2' through a data line D'. A third N-type transistor N2 serving as a switch and a fourth N-type transistor N3 for resetting are further included on the data line D'. Referring to FIG. 1, in the process of driving the pixel circuit to operate, a first level and a second level outputted by a digital-to-analog converter (DAC) are inputted to an input terminal of the SOP. A gamma voltage is inputted to an input terminal of the DAC. When the gamma voltage includes 65 voltage values, the first level and the second level are two adjacent gamma voltages among gamma voltages GAMMA<65:1> selected by the DAC according to DATA<7:2> among DATA<7:0>. DATA<7:0> denotes an 8-bit digital signal and DATA<7:2> denotes the high-order 6 bits in DATA<7:0>. The SOP interpolates a data voltage V_DATA corresponding to a gray scale between voltages at the first level and the second level according to data DATA<1:0> and outputs the data voltage V_DATA to the second N-type transistor N4. DATA<1:0> denotes the lower 2 bits in DATA<7:0>. The SOP may be a multi-bit interpolation circuit or a unity gain buffer circuit, which is not limited in this embodiment.

A specific operation process of the data current generation circuit is as follows: at a reset stage during the pixel circuit 2' is driven to operate, a reset control signal outputted from a reset control signal input terminal SA' is at a high level, a switch control signal outputted from a switch control input terminal SB' is at a low level, and the data voltage V_DATA outputted by the SOP is inputted to a gate of the first N-type transistor Ni through the second N-type transistor N4 and maintained by a capacitor C' while an initialization signal VREF_RST is written into the pixel circuit 2' through the fourth N-type transistor N3; at a data writing stage Program during the pixel circuit 2' is driven to operate, the reset control signal outputted from the reset control signal input terminal SA' is at a low level, the switch control signal outputted from the switch control input terminal SB' is at a high level, and the first N-type transistor Ni forms a data current according to the data voltage V_DATA of the gate and inputs the data current to the pixel circuit 2' through the third N-type transistor N2; at a light-emitting stage t3 during the pixel circuit 2' is driven to operate, the reset control signal outputted from the reset control signal input terminal SA' is at a high level, the switch control signal outputted from the switch control input terminal SB' is at a low level, and the pixel circuit 2' outputs the data current to drive a light-emitting device OLED to emit light. Meanwhile, the second N-type transistor N4 and the fourth N-type transistor N3 are turned on to prepare for outputting the data voltage V_DATA for the next frame. As can be seen from the preceding process of driving the pixel circuit 2' to operate, the first N-type transistor N1 converts the data voltage V_DATA into the data current to provide the pixel circuit 2' with the data current I_DATA. However, the first N-type transistor N1 has a deviation in threshold voltage so that the data current I_DATA converted by the first N-type transistor Ni deviates a little from the data voltage V_DATA. Therefore, different data current generation circuits 1' output different data currents I_DATA, resulting in different brightness of light emitted by light-emitting devices OLED and poor uniformity of a display panel.

Figure 2:
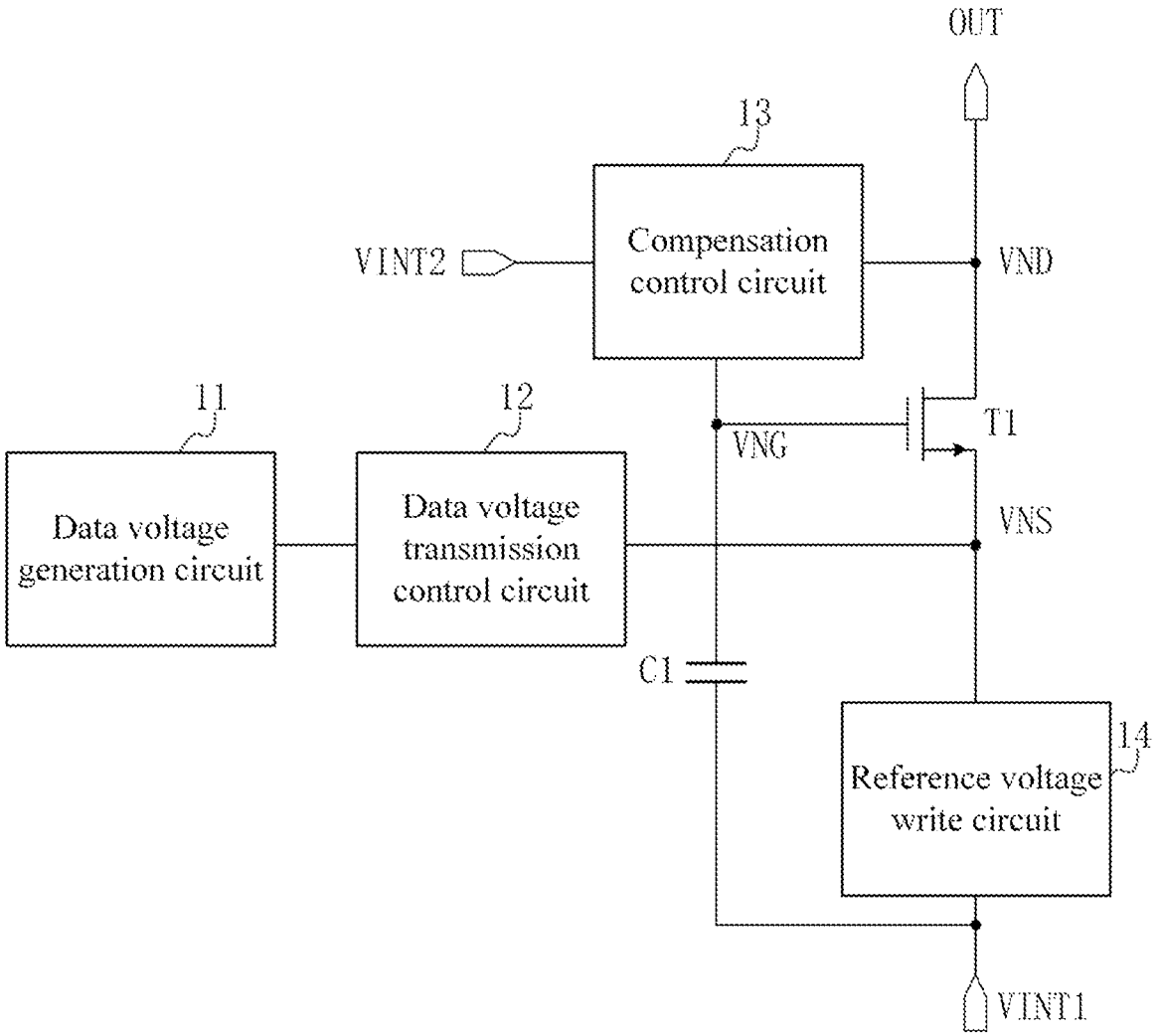
FIG. 2 is a structure diagram of a data current generation circuit according to an embodiment of the present disclosure.

To solve the preceding problem, an embodiment of the present disclosure provides a data current generation circuit. As shown in FIG. 2 which is a structure diagram of a data current generation circuit according to an embodiment of the present disclosure, the data current generation circuit includes a data voltage generation circuit 11, a data voltage transmission control circuit 12, a compensation control circuit 13, a first capacitor C1, a first transistor T1 and a reference voltage writing circuit 14.

The data voltage generation circuit 11 is configured to generate a data voltage.

The data voltage transmission control circuit 12 is connected between the data voltage generation circuit 11 and a first electrode of the first transistor T1 and configured to transmit the data voltage to the first electrode of the first transistor T1. The compensation control circuit 13 is electrically connected to a gate of the first transistor T1 and a second electrode of the first transistor T1 separately and configured to associate a threshold voltage of the first transistor T1 with the gate of the first transistor T1. The first capacitor C1 includes a first electrode electrically connected to the gate of the first transistor T1 and a second electrode electrically connected to a first reference voltage output terminal and is configured to store a voltage of the gate of the first transistor T1. The reference voltage writing circuit 14 is electrically connected to the first electrode of the first transistor T1 and the first reference voltage output terminal VINT1 separately and configured to write a first reference voltage of the first reference voltage output terminal VINT1 into the first electrode of the first transistor T1. The second electrode of the first transistor T1 serves as an output terminal OUT of the data current generation circuit and is configured to output a data current according to the voltage of the gate of the first transistor T1.

In the present disclosure, the data current generation circuit includes the data voltage generation circuit, the data voltage transmission control circuit, the compensation control circuit, the first capacitor, the first transistor and the reference voltage writing circuit. In an operation process of the data current generation circuit, the data voltage generation circuit can generate the data voltage and transmit the data voltage to the first electrode of the first transistor through the data voltage transmission control circuit, the compensation control circuit can associate the threshold voltage of the first transistor with the gate of the first transistor, the first capacitor stores the voltage of the gate of the first transistor, then the reference voltage writing circuit can write the first reference voltage to the first electrode of the first transistor, and the second electrode of the first transistor serves as the output terminal and outputs the data current according to the voltage of the gate. In this embodiment, the voltage of the gate of the first transistor for outputting the data current is related to the threshold voltage of the first transistor. When the first transistor outputs the data current, the voltage of the gate can compensate for an effect of the threshold voltage of the first transistor on the data current so that a degree of matching between the data voltage and the data current can be improved, thereby improving the uniformity of the display panel.

The preceding is the core idea of the present disclosure. Hereinafter, the technical solutions in embodiments of the present disclosure will be described clearly and completely in conjunction with drawings in the embodiments of the present disclosure. Based on the embodiments of the present disclosure, all other embodiments obtained by those having ordinary skill in the art without creative work are within the scope of the present disclosure.

Figure 3:
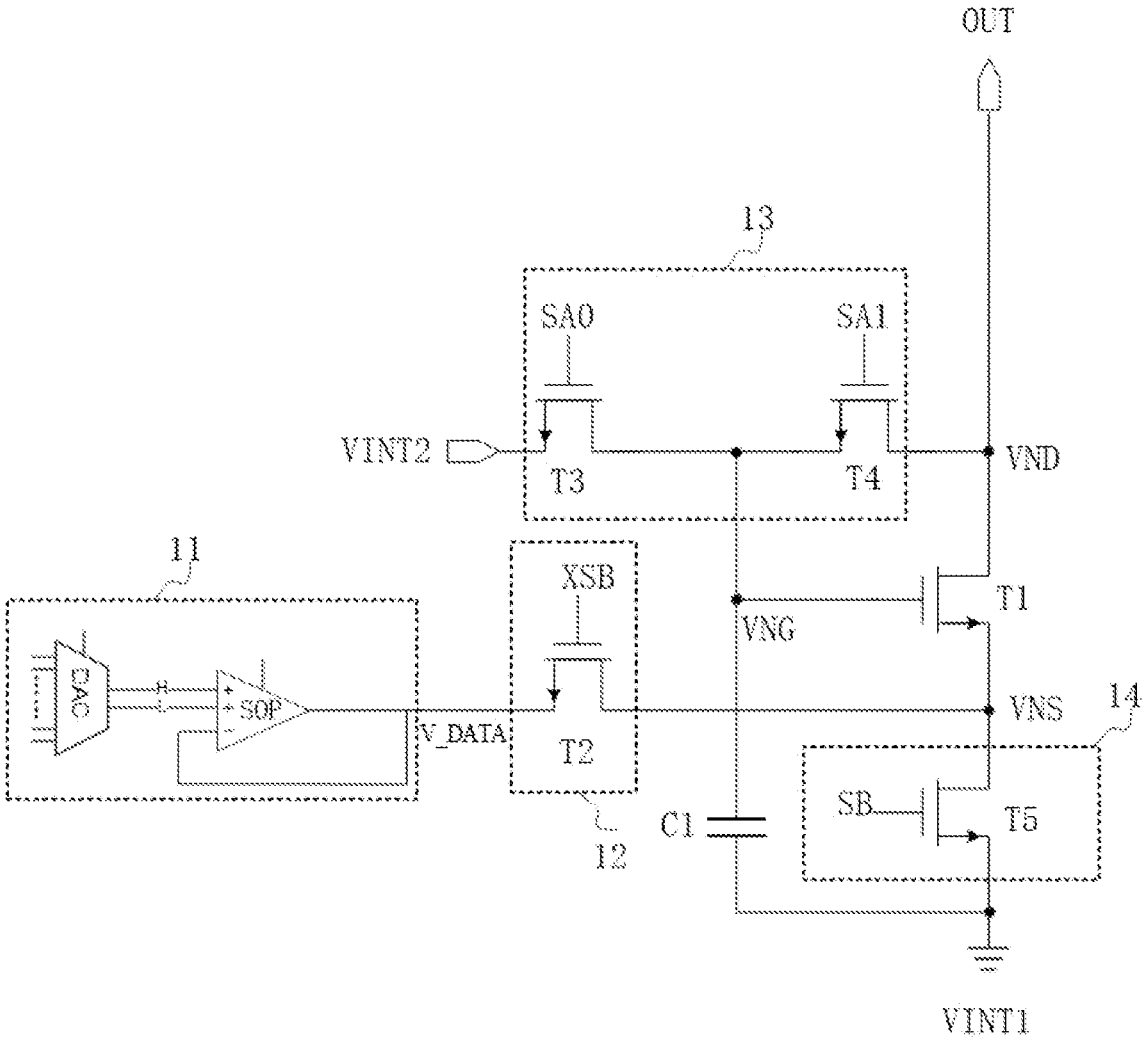
FIG. 3 is another structure diagram of a data current generation circuit according to an embodiment of the present disclosure.

FIG. 3 is another structure diagram of a data current generation circuit according to an embodiment of the present disclosure. Specifically and optionally, the data voltage transmission control circuit 12 may include a second transistor T2; where the second transistor T2 includes a gate electrically connected to a first control signal input terminal XSB, a first electrode electrically connected to the data voltage generation circuit 11, and a second electrode electrically connected to the first electrode of the first transistor T1.

The data voltage generation circuit 11 outputs the data voltage, the data voltage transmission control circuit 12 may include the second transistor T2, the gate of the second transistor T2 is connected to the first control signal input terminal XSB, the first electrode of the second transistor T2 is connected to the data voltage generation circuit 11, the second electrode of the second transistor T2 is electrically connected to the first electrode of the first transistor T1, and the first control signal input terminal XSB may control the second transistor T2 to be turned on or off, so as to control whether the first electrode of the first transistor T1 acquires the data voltage outputted by the data voltage generation circuit 11. The data voltage transmission control circuit 12, as a switch element for connecting the data voltage generation circuit 11 and the first electrode of the first transistor T1, may be controlled to be turned on or off, so as to change a voltage of the first electrode of the first transistor T1. Optionally, the data voltage transmission control circuit 12 in this embodiment may be composed of other switch devices in addition to the second transistor T2, which is not limited in this embodiment.

With continued reference to FIG. 3, optionally, the compensation control circuit 13 may include a third transistor T3 and a fourth transistor T4; where the third transistor T3 includes a gate electrically connected to a second control signal input terminal SA0, a first electrode electrically connected to a second reference voltage output terminal VINT2, and a second electrode electrically connected to a first electrode of the fourth transistor T4; and the fourth transistor T4 further includes a gate electrically connected to a third control signal input terminal SA1 and a second electrode electrically connected to the second electrode of the first transistor T1.

The compensation control circuit 13 may include the third transistor T3 and the fourth transistor T4, the gate of the third transistor T3 is connected to the second control signal input terminal SA0, the gate of the fourth transistor T4 is connected to the third control signal input terminal SA1, and the third transistor T3 and the fourth transistor T4 are connected in sequence, that is, the first electrode of the third transistor T3 is connected to the second reference voltage output terminal VINT2 to acquire a second reference voltage, the second electrode of the third transistor T3 is connected to the first electrode of the fourth transistor T4, and the second electrode of the fourth transistor T4 is connected to the second electrode of the first transistor T1. Optionally, in this embodiment, the third transistor T3 and the fourth transistor T4 are not turned on at the same time, that is, when one of the third transistor T3 and the fourth transistor T4 is turned on, the other one is turned off The compensation control circuit 13 can associate the threshold voltage VTHN of the first transistor T1 with the gate of the first transistor T1 so that after the first transistor T1 is turned on, the threshold voltage VTHN associated with the gate of the first transistor T1 can compensate for the effect of the threshold voltage of the first transistor T1 on the data current.

With continued reference to FIG. 3, optionally, the reference voltage writing circuit 14 may include a fifth transistor T5; where the fifth transistor T5 includes a gate electrically connected to a fourth control signal input terminal SB, a second electrode electrically connected to the first electrode of the first transistor T1, and a first electrode electrically connected to the first reference voltage output terminal VINT1.

The reference voltage writing circuit 14 includes the fifth transistor T5 so that the reference voltage writing circuit 14 can control the first electrode of the first transistor T1 to be connected to or disconnected from the first reference voltage output terminal VINT1 through the fifth transistor T5 being turned on or off. Then, the voltage of the first electrode of the first transistor T1 can instantaneously change. Exemplarily, as shown in FIG. 3, when the second transistor T2 is turned on and the fifth transistor T5 is turned off, the data voltage V_DATA may be inputted to the first electrode of the first transistor T1; and when the second transistor T2 is turned off and the fifth transistor T5 is turned on, the first reference voltage VINT1 may be inputted to the first electrode of the first transistor T1. The reference voltage writing circuit 14 can change the voltage of the first electrode of the first transistor T1 to the first reference voltage VINT1 so that the threshold voltage VTHN of the first transistor T1 and the data voltage V_DATA are easy to be superimposed to the gate of the first transistor T1 and the data current generated by the first transistor T1 is related to the data voltage V_DATA only, thereby improving the degree of matching between the data voltage and the data current and improving the uniformity of the display panel.

In this embodiment, the gate of the fifth transistor T5 is connected to the fourth control signal input terminal SB. Optionally, a first control signal inputted from the first control signal input terminal XSB and a fourth control signal inputted from the fourth control signal input terminal SB may be reverse to each other. In this embodiment, since both the fifth transistor T5 and the second transistor T2 are connected to the first electrode of the first transistor T1 and the first electrode of the first transistor T1 cannot be connected to different potentials at the same time, the first control signal inputted from the first control signal input terminal XSB and the fourth control signal inputted from the fourth control signal input terminal SB may be reverse to each other so that the second transistor T2 and the fifth transistor T5 cannot be turned on at the same time.

Figure 4:
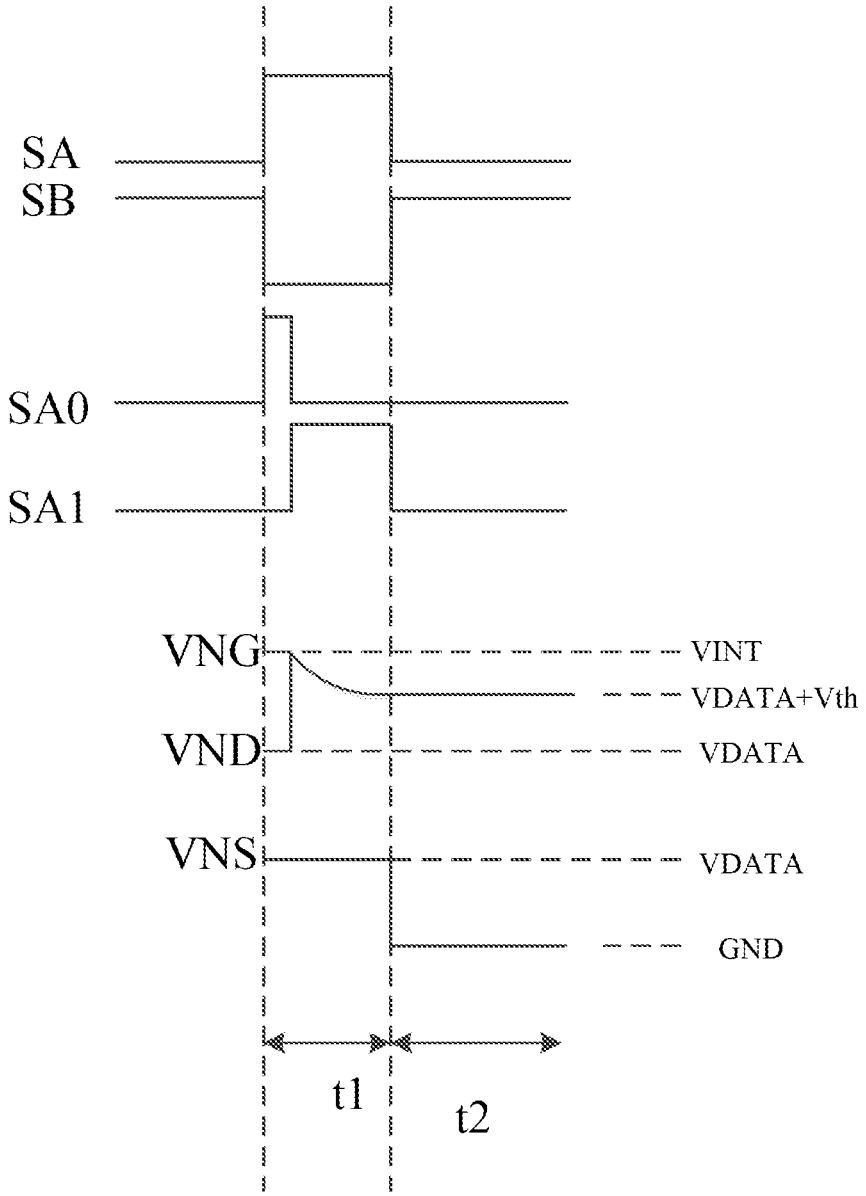
FIG. 4 is a timing diagram of the data current generation circuit in FIG. 3.

Based on the preceding embodiments, the specific coordination and operation process of the preceding circuit is described in detail. It is to be noted that the transistors T1 to T5 may all be N-type transistors which are turned on at a high level and turned off at a low level. As shown in FIG. 4 which is a timing diagram of the data current generation circuit shown in FIG. 3, the detailed operation process of the data current generation circuit is described below.

As shown in FIGS. 3 and 4, at a first stage of an initialization stage t1, the fourth control signal SB=0 (0 denotes the low level and 1 denotes the high level), the first control signal XSB=1, a second control signal SA0=1, and a third control signal SA1=0. Therefore, the second transistor T2 is turned on and outputs the data voltage V_DATA and the voltage VNS of the first electrode of the first transistor T1 is VNS=V_DATA; the third transistor T3 is turned on, the second reference voltage output terminal outputs the second reference voltage VINT2 to the gate of the first transistor T1 through the third transistor T3, the voltage VNG of the gate of the first transistor T1 is VNG=VINT2, and the first capacitor C1 maintains the second reference voltage VINT2; and a voltage VND of the second electrode of the first transistor is VND=VNS=V_DATA.

At a second stage of the initialization stage t1, the fourth control signal SB=0, the first control signal XSB=1, and the second stage is different from the first stage in that the second control signal SA0=0 and the third control signal SA1=1. Therefore, the third transistor T3 is turned off and the fourth transistor T4 is turned on so that the gate and the second electrode of the first transistor T1 are shorted. Since there is no current path in the first transistor T1, the voltage VNG gradually decreases and finally a gate-source voltage of the first transistor T1 is equal to the threshold voltage VTHN of the first transistor T1, that is, VNG−VNS=VTHN. At this time, the first transistor T1 generates no current, and the voltage (VNG=VND=V_DATA+VTHN) of the gate of the first transistor T1 is maintained by the first capacitor C1.

At a programming stage t2, the fourth control signal SB=1, the first control signal XSB=0, the second control signal SA0=0, and the third control signal SA1=0. Therefore, the second transistor T2, the third transistor T3 and the fourth transistor T4 are turned off, the fifth transistor T5 is turned on, and the voltage VNS of the first electrode of the first transistor T1 is VNS=VINT1. Exemplarily, in this embodiment, the first reference voltage output terminal may be a ground terminal, and then the first electrode of the fifth transistor T5 may be connected to the ground terminal. Of course, the first reference voltage VINT1 may have other values, which is not limited in this embodiment. Then, the gate-source voltage VGS of the first transistor T1 is VGS=VNG−VNS=V_DATA+VTHN; and the first transistor T1 generates the data current $$\text{ID_T1} = \frac{1}{2} * \mu_n * Cox * \frac{W}{L} * (VGS - VTHN)^2 =$$

-continued $$\frac{1}{2} * \mu_n * Cox * \frac{W}{L} * (VDATA + VTHN - VTHN)^2 = \frac{1}{2} * \mu_n * Cox * \frac{W}{L} * (VDATA)^2,$$

where $\mu_n$ denotes a carrier mobility of a current output transistor Tout, Cox denotes a channel capacitance constant of the first transistor T1, W denotes a channel width of the first transistor T1, and L denotes a channel length of the first transistor T1. It can be known that the data current generation circuit can eliminate the effect of the threshold voltage of the first transistor T1 on a current source of the first transistor T1 and eliminate an effect of a power supply at the source of the first transistor T1 on the current source of the first transistor T1. Therefore, the degree of matching between the data voltage and the data current can be improved, thereby improving the uniformity of the display panel.

It can be obtained from the preceding current formula $$\text{ID_T1} = \frac{1}{2} * \mu_n * Cox * \frac{W}{L} * (\text{V_DATA})^2$$

for the data current ID_T1 that in the case where a range of ID_T1 remains unchanged, a range of V_DATA can be increased through a decrease in size of W/L, that is, a range of the gamma voltage is increased, thereby improving the adjustment effect of a color shift of the entire display panel and improving the display brightness of the panel. In addition, the data current generation circuit provided in this embodiment for compensating for the pixel circuit is an external compensation circuit and only one row of data current generation circuits need to be arranged. Each data current generation circuit corresponds to one column of pixel circuits and provides compensation for pixel circuits in the corresponding column. Since the number of data current generation circuits is relatively small, the sizes of the preceding transistors T1 to T5 may not be limited. If process conditions permit, the value of W/L may be decreased by increasing L and decreasing W for the transistor T1 to increase the range of the gamma voltage.

It is to be noted that the operation timing provided in the preceding embodiment is one of operation timings of the data current generation circuit, and the data current generation circuit in the embodiment of the present disclosure includes, but is not limited to, the preceding operation timing.

An embodiment of the present disclosure further provides a data current driver chip including the data current generation circuit according to any embodiment of the present disclosure. Therefore, the data current driver chip has all the technical features of the data current generation circuit according to any embodiment of the present disclosure and thus has the same beneficial effects as the data current generation circuit according to any embodiment of the present disclosure. Details are not repeated here.

Figure 5:
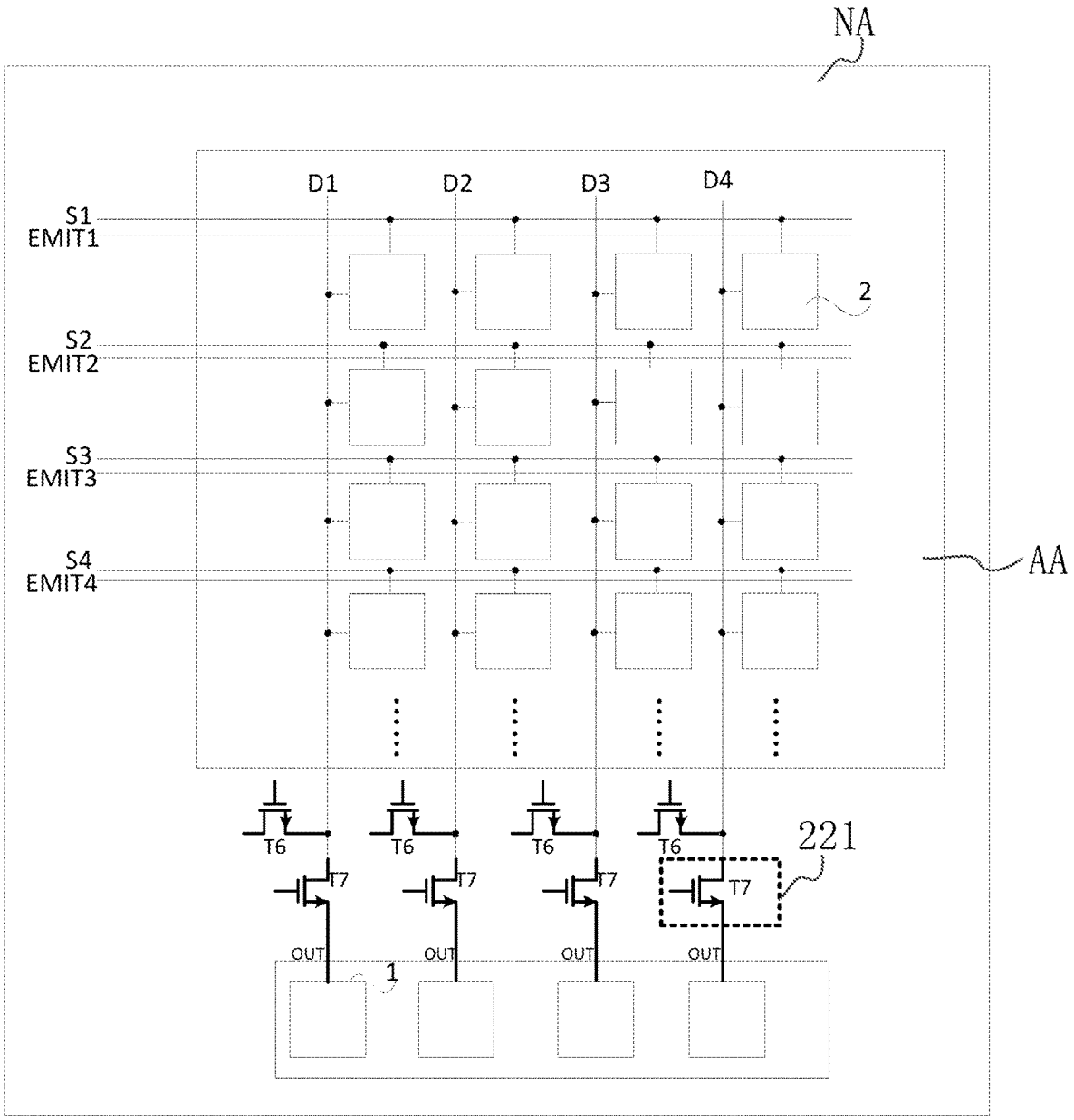
FIG. 5 is a structure diagram of a display panel according to an embodiment of the present disclosure.

An embodiment of the present disclosure further provides a display panel. FIG. 5 is a structure diagram of a display panel according to an embodiment of the present disclosure. The display panel includes a display region AA and a non-display region NA; where the display region AA is provided with a plurality of pixel circuits 2 and the non-display region NA is provided with the data current generation circuit 1 according to any embodiment of the present disclosure.

The plurality of pixel circuits 2 are electrically connected to the data current generation circuit 1 through a data line (D1, D2, D3, D4 or the like) and a switch circuit T7; and the data current generation circuit 1 provides a data current for the plurality of pixel circuits 2 through the data line and the switch circuit T7.

Specifically, the display region AA includes a plurality of pixel units, each of which includes one pixel circuit 2. The non-display region NA includes a gate driver circuit and a data driver circuit. The gate driver circuit provides a scan signal for the pixel circuits 2 through a scan line (S1, S2, S3, S4 or the like) and the data driver circuit provides a data current for the pixel circuits 2 through the data line (D1, D2, D3, D4 or the like). The pixel circuits 2 are connected to the corresponding data line (D1, D2, D3, D4 or the like) under the action of the scan signal. When the switch circuit T7 is turned on, the data line (D1, D2, D3, D4 or the like) acquires the data current from the data current generation circuit 1 in the data driver circuit and transmits the data current to the pixel circuits 2, whereby the pixel circuits implement the display of display panel.

Figure 6:
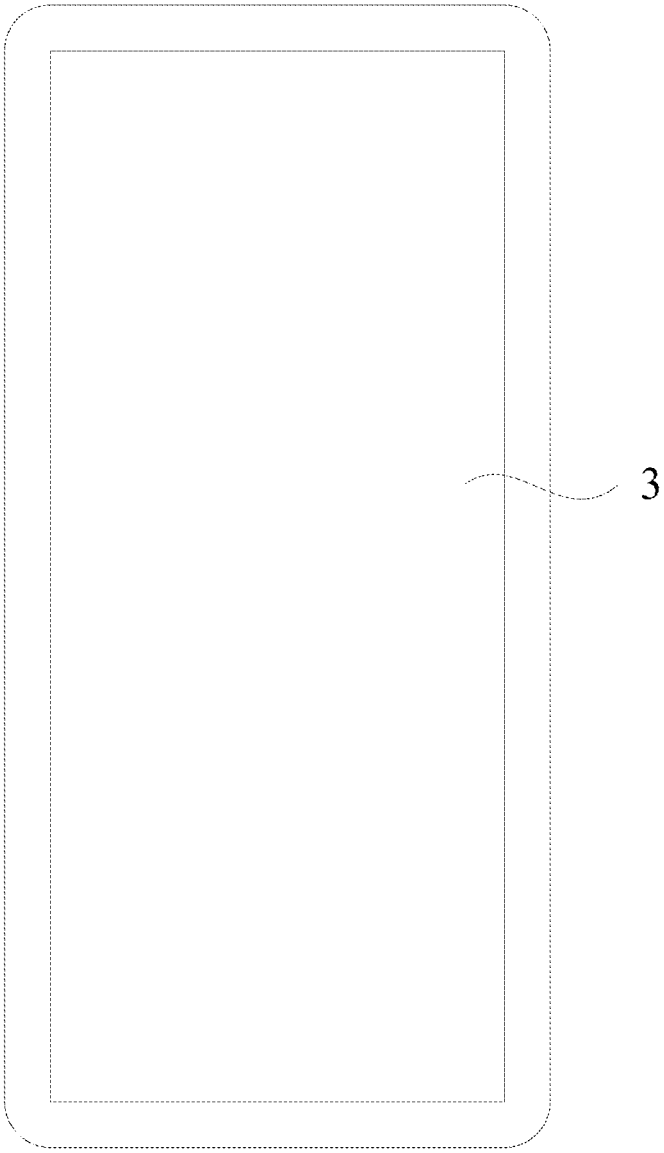
FIG. 6 is a structure diagram of a display device according to an embodiment of the present disclosure.

FIG. 6 is a structure diagram of a display device according to an embodiment of the present disclosure. The display panel may be a display panel 3 of a mobile phone shown in FIG. 6. The display panel may also be a display panel of an electronic device such as a computer, a television or a smart wearable display device, which is not particularly limited in this embodiment.

Optionally, with continued reference to FIG. 5, the display panel may further include a sixth transistor T6 and the switch circuit includes a seventh transistor T7; where the sixth transistor T6 includes a gate electrically connected to a reset control signal input terminal SA, a first electrode electrically connected to data current input terminals IN1 of the plurality of pixel circuits 2 through the data line, and a second electrode electrically connected to a reset signal input terminal RST; and the seventh transistor T7 includes a gate electrically connected to a fifth control signal input terminal SB, a first electrode electrically connected to a second electrode of a first transistor T1 in the data current generation circuit 1, and a second electrode electrically connected to the data current input terminals IN1 of the plurality of pixel circuits 2 through the data line.

The sixth transistor T6 can control whether the data current input terminals IN1 of the pixel circuits 2 have access to a reset signal to be reset. Specifically, the sixth transistor T6 includes the gate connected to the reset control signal input terminal SA, the first electrode connected to the data current input terminals IN1 of the pixel circuits 2 through the data line, and the second electrode connected to the reset signal input terminal RST. When the reset control signal input terminal SA inputs a reset control signal to the sixth transistor T6, the sixth transistor T6 inputs a reset signal RST to the data current input terminals IN1. When the sixth transistor T6 is turned off and the seventh transistor T7 is turned on, the fifth control signal input terminal SB outputs a first control signal to the gate of the seventh transistor T7. Since the first electrode of the seventh transistor T7 is connected to the second electrode of the first transistor T1 and the second electrode of the seventh transistor T7 is connected to the data current input terminals IN1, the data current may be transmitted to the data current input terminals IN1 of the pixel circuits 2 through the seventh transistor T7 so that the pixel circuits 2 have access to the reset signal RST at an initialization stage and have access to the data current at a programming stage.

Figure 7:
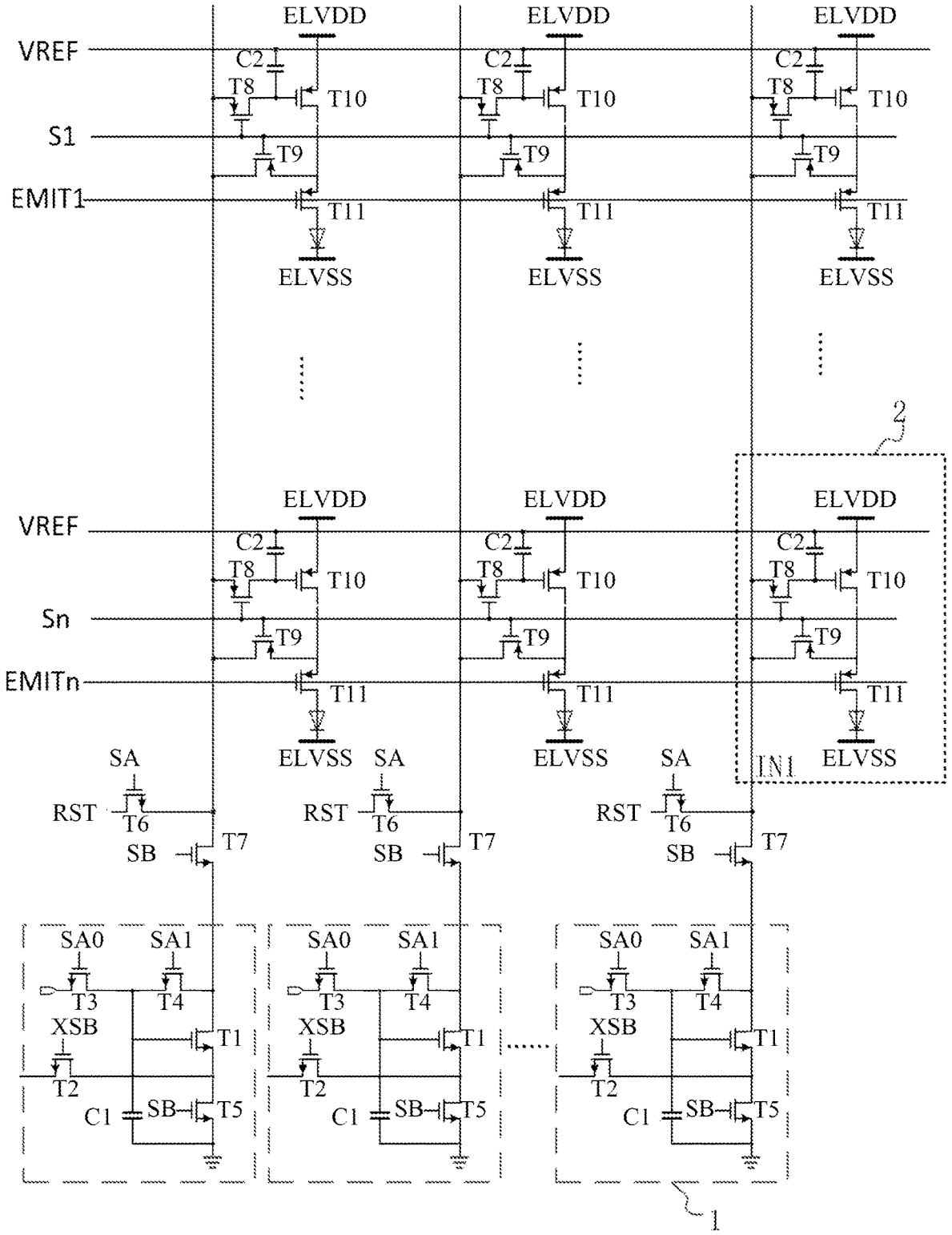
FIG. 7 is another structure diagram of a display panel according to an embodiment of the present disclosure.
Figure 8:
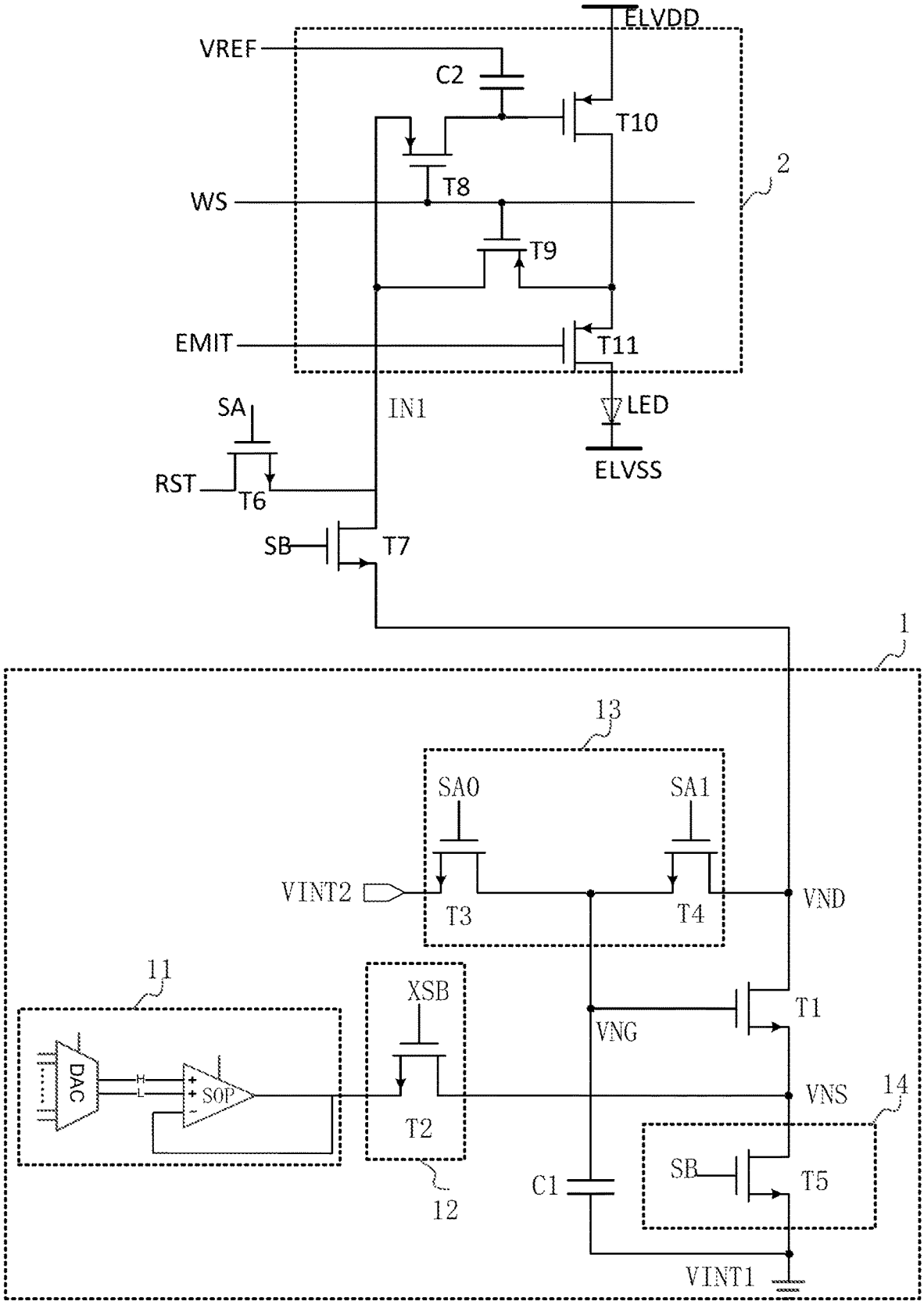
FIG. 8 is a structure diagram of a pixel circuit and a data current generation circuit in one group in FIG. 7.

FIG. 7 is another structure diagram of a display panel according to an embodiment of the present disclosure. FIG. 8 is a structure diagram of a pixel circuit and a data current generation circuit in one group in FIG. 7. Optionally, the seventh transistor T7 is turned on at the same timing as a fifth transistor T5. The seventh transistor T7 is configured to transmit the data current to the pixel circuits 2. When the seventh transistor T7 is turned on, the first transistor T1 needs to be turned on to generate the data current and the fifth transistor T5 needs to be turned on to form a data current path. With reference to FIG. 8, optionally, the fifth transistor T5 may be turned on earlier than the seventh transistor T7 so that the fifth transistor T5 and the seventh transistor T7 are turned on at different time points. In this case, when a voltage VNS of a first electrode of the first transistor T1 is equal to the first reference voltage VINT1, since the seventh transistor T7 is not turned on and there is no current through the first transistor T1, when the fifth transistor T5 is turned on, there is no dynamic voltage drop on a first reference voltage output terminal VINT1 and source and drain voltages of the first transistor T1 in each data current generation circuit are maintained consistent, thereby improving the uniformity of the data current. Thereafter, the seventh transistor T7 is turned on so that the data current is transmitted to the pixel circuits 2 through the seventh transistor T7.

With continued reference to FIG. 8, optionally, the pixel circuit 2 may include an eighth transistor T8, a ninth transistor T9, a tenth transistor T10, an eleventh transistor T11, a second capacitor C2 and a light-emitting device OLED; where a first electrode of the eighth transistor T8 and a second electrode of the ninth transistor T9 are electrically connected to the data current input terminal IN1 of the pixel circuit 2, a second electrode of the eighth transistor T8 is electrically connected to a gate of the tenth transistor T10 and a first electrode of the second capacitor C2, a gate of the eighth transistor T8 and a gate of the ninth transistor T9 are electrically connected to a scan signal input terminal WS of the pixel circuit 2, a first electrode of the ninth transistor T9 is electrically connected to a second electrode of the tenth transistor T10, a first electrode of the tenth transistor T10 is electrically connected to a first power signal input terminal ELVDD of the pixel circuit 2, a second electrode of the second capacitor C2 is electrically connected to a third reference voltage input terminal VREF of the pixel circuit 2, the second electrode of the tenth transistor T10 is electrically connected to a first electrode of the eleventh transistor T11, a gate electrode of the eleventh transistor T11 is electrically connected to a light emission control signal input terminal EMIT of the pixel circuit 2, a second electrode of the eleventh transistor T11 is electrically connected to an anode of the light-emitting device OLED, and a cathode of the light-emitting device OLED is electrically connected to a second power signal input terminal ELVSS of the pixel circuit 2.

Figure 9:
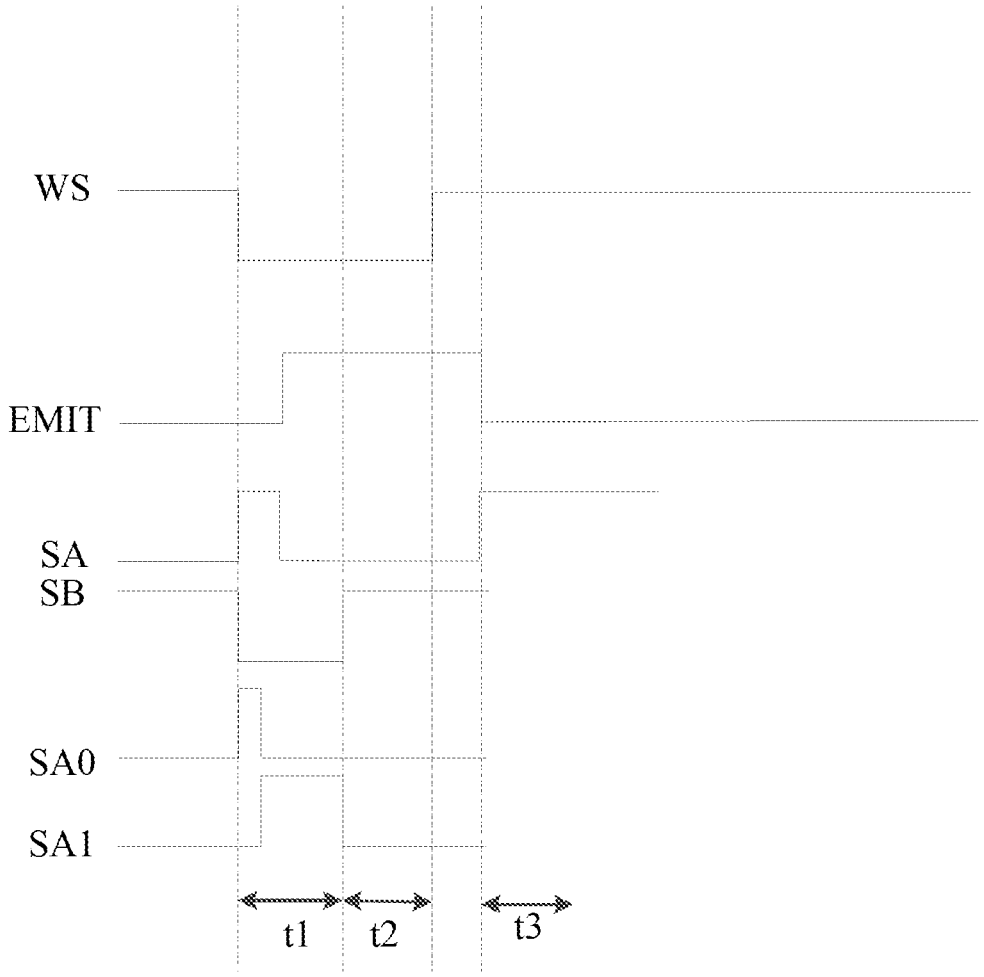
FIG. 9 is a timing diagram of the data current generation circuit and the pixel circuit in FIG. 8.

Optionally, the transistors T8 to T11 in the pixel circuit 2 are all P-type transistors which are turned on at a low level and turned off at a high level. A light-emitting process of the pixel unit will be described below in detail in conjunction with the timings of the pixel circuit 2 and the data current generation circuit 1 in coordination. As shown in FIG. 9, FIG. 9 is a timing diagram of the data current generation circuit and the pixel circuit in FIG. 8.

At a first stage of the initialization stage t1, WS is at the low level, EMIT is at the low level, SB is at the low level, XSB is at the high level, SA is at the high level, SA0 is at the high level, and SA1 is at the low level. At this time, a second transistor T2, a third transistor T3, the sixth transistor T6, the eighth transistor T8, the ninth transistor T9 and the eleventh transistor T11 are turned on. A data voltage outputted by a data voltage generation circuit 11 is inputted to the first electrode of the first transistor T1 through the second transistor T2, and a voltage VNS of the first electrode of the first transistor T1 is VNS=V_DATA. The third transistor T3 is turned on, a second reference voltage output terminal outputs a second reference voltage VINT2 to a gate of the first transistor T1 through the third transistor T3, a voltage VNG of the gate of the first transistor T1 is VNG=VINT2, and a first capacitor C1 maintains the second reference voltage VINT2. A voltage VND of the second electrode of the first transistor is VND=VNS=V_DATA. Meanwhile, the reset signal RST is inputted to the gate of the tenth transistor T10 through the sixth transistor T6 and the eighth transistor T8, inputted to the second electrode of the tenth transistor T10 through the sixth transistor T6 and the ninth transistor T9, and written into the anode of the light-emitting device OLED through the eleventh transistor T11 so that the light-emitting device OLED is in a reset state.

At a second stage of the initialization stage t1, WS is at the low level, EMIT may be switched from the low level to the high level, and when EMIT is switched from the low level to the high level, SA is switched from the high level to the low level, SB is at the low level, and XSB is at the high level. The second stage is different from the first stage in that SA0 is at the low level and SA1 is at the high level. Therefore, the second transistor T2, a fourth transistor T4, the eighth transistor T8, the ninth transistor T9 and the eleventh transistor T11 are turned on. The sixth transistor T6 and the eleventh transistor T11 are switched from an on state to an off state, and the light-emitting device OLED stops receiving the reset signal. With respect to the first stage, the third transistor T3 is turned off and the fourth transistor T4 is turned on so that the gate and the second electrode of the first transistor T1 are shorted. Since there is no current path in the first transistor T1, the voltage VNG gradually decreases and finally a gate-source voltage of the first transistor T1 is equal to a threshold voltage VTHN of the first transistor T1, that is, VNG−VNS=VTHN. At this time, the first transistor T1 generates no current, and the voltage (VNG=VND=V_DATA+VTHN) of the gate of the first transistor T1 is maintained by the first capacitor C1.

At the programming stage t2, WS is at the low level, EMIT is at the high level, SA is at the low level, SB is at the high level, XSB is at the low level, SA1 is at the low level, and SA0 is at the low level so that the fifth transistor T5, the first transistor T1, the seventh transistor T7, the eighth transistor T8 and the ninth transistor T9 are turned on, the voltage (VNG=VND=V_DATA+VTHN) of the gate of the first transistor T1 is maintained, a voltage of the gate of the tenth transistor T10 is RST, and a voltage of the second electrode of the tenth transistor T10 is RST. In this way, the first transistor T1 and the tenth transistor T10 determine a current in an equilibrium state. Specifically, the voltage VNS of the first electrode of the first transistor T1 is VNS=VINT1. Exemplarily, the first reference voltage output terminal in this embodiment may be a ground terminal, and then a first electrode of the fifth transistor T5 may be connected to the ground terminal. Of course, a first reference voltage VINT1 may have other values, which is not limited in this embodiment. Then, the gate-source voltage VGS of the first transistor T1 is VGS=VNG−VNS=V_DATA+VTHN; and the first transistor T1 generates the data current $$\mathrm{ID_T1} = \frac{1}{2} * \mu_n * Cox * \frac{W}{L} * (VGS - VTHN)^2 = \frac{1}{2} * \mu_n * Cox * \frac{W}{L} * (\mathrm{V_DATA} + VTHN - VTHN)^2 = \frac{1}{2} * \mu_n * Cox * \frac{W}{L} * (\mathrm{V_DATA})^2$$

Optionally, there may be a certain delay between SB for driving the fifth transistor T5 and SB for driving the seventh transistor T7, so as to avoid an effect of a ground voltage drop.

At a light-emitting stage t3, WS is at the high level, EMIT is at the low level, SB is at the low level, SA is at the high level, XSB is at the high level, SA1 is at the low level, and SA0 is at the low level so that the second transistor T2, the sixth transistor T6, the tenth transistor T10 and the eleventh transistor T11 are turned on, the voltage of the gate of the tenth transistor T10 remains RST, a current generated by the tenth transistor T10 is transmitted to the light-emitting device OLED through the eleventh transistor T11 to cause the light-emitting device OLED to emit light, and the sixth transistor T6 inputs the reset signal RST to the data line again and the second transistor T2 transmits the data voltage to the first electrode of the first transistor T1 again in preparation for the next initialization stage.

It is to be noted that the operation timing provided in the preceding embodiment is one of operation timings of the data current generation circuit and the pixel circuit, and the data current generation circuit in the embodiment of the present disclosure includes, but is not limited to, the preceding operation timing.

Figure 10:
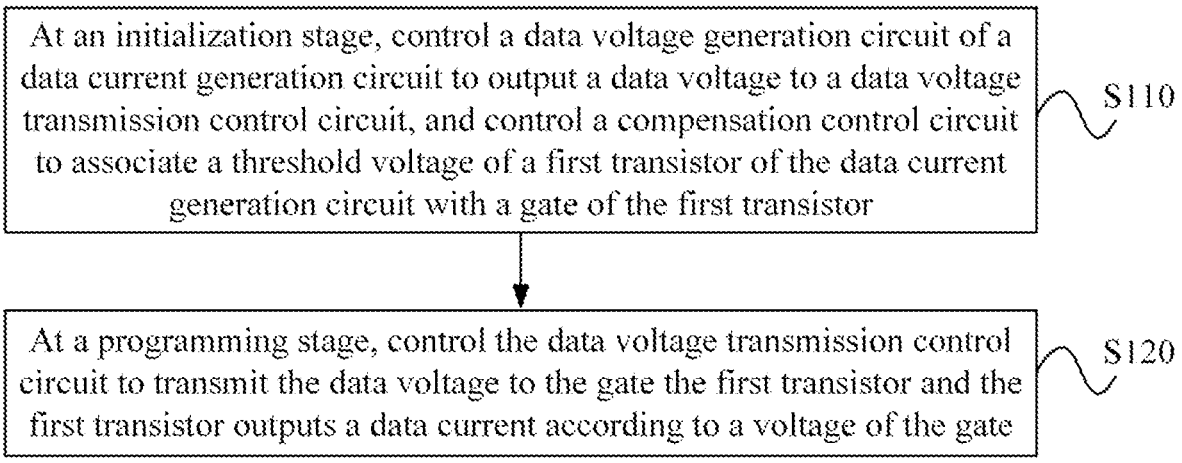
FIG. 10 is a flowchart of a method for driving a data current generation circuit according to an embodiment of the present disclosure.

Based on the same concept, an embodiment of the present disclosure further provides a method for driving a data current generation circuit. FIG. 10 is a flowchart of a method for driving a data current generation circuit according to an embodiment of the present disclosure. As shown in FIG. 10, the method in this embodiment includes steps described below.

In step S110, at an initialization stage, a data voltage generation circuit of the data current generation circuit is controlled to output a data voltage to a data voltage transmission control circuit and a compensation control circuit is controlled to associate a threshold voltage of a first transistor of the data current generation circuit with a gate of the first transistor.

In step S120, at a programming stage, the data voltage transmission control circuit is controlled to output the data voltage to the gate of the first transistor and the first transistor outputs a data current according to a voltage of the gate.

In the embodiment of the present disclosure, the data current generation circuit includes the data voltage generation circuit, the data voltage transmission control circuit, the compensation control circuit, a first capacitor, the first transistor and a reference voltage writing circuit. In an operation process of the data current generation circuit, the data voltage generation circuit can generate the data voltage and transmit the data voltage to a first electrode of the first transistor through the data voltage transmission control circuit, the compensation control circuit can associate the threshold voltage of the first transistor with the gate of the first transistor, the first capacitor stores the voltage of the gate of the first transistor, then the reference voltage writing circuit can write a first reference voltage to the first electrode of the first transistor, and a second electrode of the first transistor serves as an output and outputs the data current according to the voltage of the gate. In this embodiment, the voltage of the gate of the first transistor for outputting the data current is related to the threshold voltage of the first transistor. When the first transistor outputs the data current, the voltage of the gate can compensate for an effect of the threshold voltage of the first transistor on the data current so that a degree of matching between the data voltage and the data current can be improved, thereby improving the uniformity of a display panel.

It is to be noted that the above are merely preferred embodiments of the present disclosure and the principles used therein. It will be understood by those skilled in the art that the present disclosure is not limited to the embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A data current generation circuit, wherein is an external compensation circuit outside pixel circuit for compensating the pixel circuit, comprising: a data voltage generation circuit, a data voltage transmission control circuit, a compensation control circuit, a first capacitor, a first transistor and a reference voltage writing circuit; wherein the data voltage generation circuit is configured to generate a data voltage;

the data voltage transmission control circuit is connected between the data voltage generation circuit and a first electrode of the first transistor and configured to transmit the data voltage to the first electrode of the first transistor;

the compensation control circuit is electrically connected to a gate of the first transistor and a second electrode of the first transistor separately and configured to associate a threshold voltage of the first transistor with the gate of the first transistor;

the first capacitor comprises a first electrode electrically connected to the gate of the first transistor and a second electrode electrically connected to a first reference voltage output terminal and is configured to store a voltage of the gate of the first transistor;

the reference voltage writing circuit is electrically connected to the first electrode of the first transistor and the first reference voltage output terminal separately and configured to write a first reference voltage of the first reference voltage output terminal into the first electrode of the first transistor; and the second electrode of the first transistor serves as an output terminal of the data current generation circuit and is configured to, according to the voltage of the gate of the first transitor, output a data current to the pixel circuit.

2. The data current generation circuit of claim 1, wherein the data voltage transmission control circuit comprises a second transistor;

wherein the second transistor comprises a gate electrically connected to a first control signal input terminal, a first electrode electrically connected to the data voltage generation circuit, and a second electrode electrically connected to the first electrode of the first transistor.

3. The data current generation circuit of claim 2, wherein the reference voltage writing circuit comprises a fifth transistor;

wherein the fifth transistor comprises a gate electrically connected to a fourth control signal input terminal, a second electrode electrically connected to the first electrode of the first transistor, and a first electrode electrically connected to the first reference voltage output terminal.

4. The data current generation circuit of claim 1, wherein the compensation control circuit comprises a third transistor and a fourth transistor;

wherein the third transistor comprises a gate electrically connected to a second control signal input terminal, a first electrode electrically connected to a second reference voltage output terminal, and a second electrode electrically connected to a first electrode of the fourth transistor; and wherein the fourth transistor further comprises a gate electrically connected to a third control signal input terminal and a second electrode electrically connected to the second electrode of the first transistor.

5. The data current generation circuit of claim 1, wherein a first control signal inputted from a first control signal input terminal and a fourth control signal inputted from a fourth control signal input terminal are reverse to each other.

6. A display panel, comprising a display region provided with a plurality of pixel circuits; and a non-display region provided with a data current generation circuit; wherein the plurality of pixel circuits are electrically connected to the data current generation circuit through a data line and a switch circuit; and the data current generation circuit comprises a data voltage generation circuit, a data voltage transmission control circuit, a compensation control circuit, a first capacitor, a first transistor and a reference voltage writing circuit; wherein the data voltage generation circuit is configured to generate a data voltage;

the data voltage transmission control circuit is connected between the data voltage generation circuit and a first electrode of the first transistor and configured to transmit the data voltage to the first electrode of the first transistor;

the compensation control circuit is electrically connected to a gate of the first transistor and a second electrode of the first transistor separately and configured to associate a threshold voltage of the first transistor with the gate of the first transistor;

the first capacitor comprises a first electrode electrically connected to the gate of the first transistor and a second electrode electrically connected to a first reference voltage output terminal and is configured to store a voltage of the gate of the first transistor;

the reference voltage writing circuit is electrically connected to the first electrode of the first transistor and the first reference voltage output terminal separately and configured to write a first reference voltage of the first reference voltage output terminal into the first electrode of the first transistor; and the second electrode of the first transistor serves as an output of the data current generation circuit and is configured to, according to the voltage of the gate of the first transistor, output a data current to the plurality of pixel circuits through the data line and the switch circuit.

7. The display panel of claim 6, further comprising a sixth transistor; wherein the switch circuit comprises a seventh transistor;

wherein the sixth transistor comprises a gate electrically connected to a reset control signal input terminal, a first electrode electrically connected to data current input terminals of the plurality of pixel circuits through the data line, and a second electrode electrically connected to a reset signal input terminal; and wherein the seventh transistor comprises a gate electrically connected to a fifth control signal input terminal, a first electrode electrically connected to a second electrode of a first transistor in the data current generation circuit, and a second electrode electrically connected to the data current input terminals of the plurality of pixel circuits through the data line.

8. The display panel of claim 7, wherein the seventh transistor is turned on at a same timing as a fifth transistor.

9. The display panel of claim 7, wherein the seventh transistor is turned on later than a fifth transistor.

10. The display panel of claim 6, wherein a pixel circuit of the plurality of pixel circuits comprises an eighth transistor, a ninth transistor, a tenth transistor, an eleventh transistor, a second capacitor and a light-emitting device;

wherein a first electrode of the eighth transistor and a second electrode of the ninth transistor are electrically connected to a data current input terminal of the pixel circuit, a second electrode of the eighth transistor is electrically connected to a gate of the tenth transistor and a first electrode of the second capacitor, a gate of the eighth transistor and a gate of the ninth transistor are electrically connected to a scan signal input terminal of the pixel circuit, a first electrode of the ninth transistor is electrically connected to a second electrode of the tenth transistor, a first electrode of the tenth transistor is electrically connected to a first power signal input terminal of the pixel circuit, a second electrode of the second capacitor is electrically connected to a third reference voltage input terminal of the pixel circuit, the second electrode of the tenth transistor is electrically connected to a first electrode of the eleventh transistor, a gate electrode of the eleventh transistor is electrically connected to a light emission control signal input terminal EMIT of the pixel circuit, a second electrode of the eleventh transistor is electrically connected to an anode of the light-emitting device, and a cathode of the light-emitting device is electrically connected to a second power signal input terminal of the pixel circuit.

11. A method for driving the data current generation circuit, which is external compensation circuit outside a pixel circuit for compensating the pixel circuit, and the data generation circuit comprises a data voltage generation circuit, a data voltage transmission control circuit, a compensation control circuit, a first capacitor, a first transistor and a reference voltage writing circuit; wherein the data voltage generation circuit is configured to generate a data voltage; the data voltage; the data voltage transmission control circuit is connected between the data voltage generation circuit and a first electrode of the first transistor and configured to transmit the data voltage to the first electrode of the first transistor; the compensation control circuit is electrically connected to a gate of the first transistor and a second electrode of the first transistor seperately and configured to associate a threshold voltage of the first transistor with the gate of the first transistor; the first capacitor comprises a first electrode electrically connected to the gate of the first transitor and a second electrod electrically connected to a first reference voltage output terminal and is configured to store a voltage of the gate of the first transistor; the reference voltage writing circuit is electrically connected to the first electrode of the first transistor and the first reference voltage output terminal seperately and configured to write a first reference voltage of the first reference voltage output terminal into the first electrode of the first transistor; and the second electrode of the transistor serves as an output terminal of the data current generation circuit and is configured to, according to the voltage of the gate of the first transistor, output a data current to the pixel circuit; and at an initialization stage, controlling a data voltage generation circuit of the data current generation circuit to output a data voltage to a data voltage transmission control circuit, controlling the data voltage transmission control circuit to transmit the data voltage to a first electrode of a first transistor while controlling a compensation control circuit to associate a threshold voltage of the first transistor of the data current generation circuit with a gate of the first transistor, and storing a voltage of the gate of the first transistor through a first capacitor; and at a programming stage, controlling a reference voltage writing circuit to write a first reference voltage into the first electrode of the first transistor and outputting, by the first transistor, the data current according to the voltage of the gate.

* * * * *